United States Patent [19]

Jones et al.

[11] 4,061,548

[45] Dec. 6, 1977

[54] ELECTROLYTIC HYDROQUINONE PROCESS

[75] Inventors: Glenn C. Jones; Ronald H. Meen, both of Kingsport, Tenn.

[73] Assignee: Eastman Kodak Company, Rochester, N.Y.

[21] Appl. No.: 693,451

[22] Filed: June 7, 1976

[51] Int. Cl.[2] ..... C25B 3/02

[52] U.S. Cl. ..... 204/78

[58] Field of Search ..... 204/78, 293

[56] References Cited

U.S. PATENT DOCUMENTS

| | | | |
|---|---|---|---|
| 3,509,031 | 4/1970 | Covitz | 204/78 |
| 3,616,323 | 10/1971 | Covitz | 204/78 |
| 3,873,580 | 3/1975 | Rennie | 204/78 |

*Primary Examiner*—R. L. Andrews

*Attorney, Agent, or Firm*—J. Frederick Thomsen; Daniel B. Reece, III

[57] ABSTRACT

The process of electrochemically oxidizing phenol to hydroquinone is improved by the inclusion of chromium ion in the aqueous reaction medium.

3 Claims, No Drawings

ELECTROLYTIC HYDROQUINONE PROCESS

This invention relates generally to an improved electrochemical oxidation process, and more specifically this invention relates to an improvement in the preparation of hydroquinone by the electrochemical oxidation of phenol.

The electrochemical oxidation of phenol to hydroquinone is known in the art. For example, U.S. Pat. No. 3,509,031 teaches the preparation of hydroquinone by a method which comprises the steps of (A) electrolyzing an aqueous solution containing about 0.5 to 4% by weight of phenol and about 1 to 35% by weight of an electrolyte at a temperature of 25 ° to about 100° C. and a pH of less than about 4 between an anode having a DC potential of at least about +0.9 volt in reference to a saturated calomel electrode and a cathode having a cathode potential more negative than about +0.4 volt in reference to a saturated calomel electrode and at a current density of at least 4 amperes per square decimeter until up to about 80% by weight of the phenol has been electrolyzed to hydroquinone; and (B) recovering the hydroquinone from the aqueous solution. The electrochemical oxidation of phenol to hydroquinone also is described in U.S. Pat. Nos. 2,135,368; 3,616,323; 3,616,324 and 3,663,381. In such an electrochemical synthesis of hydroquinone, phenol is oxidized at the anode to p-benzoquinone which is then reduced to hydroquinone at the cathode. The process preferably is carried out in an undivided cell.

Many variables are involved in electrochemical reactions and, in particular, in organic electrochemical oxidations. It is difficult to control all of these variables to render an electrochemical process commercially feasible when compared to other non-electrochemical synthesis techniques. Variables affecting these costs include cell configuration, choice of electrode material, electrode potential, current efficiency, chemical yield, current density, temperature, electrolyte composition, phenol concentration, time of reaction, percent conversion, and the like. A particularly important factor in electrochemical processes is current efficiency. In the oxidation of phenol current efficiency in percent may be calculated from the equation:

$$\text{Current Efficiency} = \frac{100\,n\,F}{It}\ \text{(moles hydroquinone)}$$

wherein $n$ = number of electrodes transferred at anode = 4 equivalents/mole;

$F$ = Faradays constant = 96,500 coulombs/equivalent;

$I$ = average current in amps;

$t$ = time in seconds.

Any improvement in the current efficiency in the electrochemical oxidation of phenol to hydroquinone and coproduct p-benzoquinone represents a significant decrease in operating costs.

We have discovered that in the electrochemical oxidation of phenol to hydroquinone at a lead or lead alloy anode according to known procedures, the current efficiency can be improved significantly by the inclusion of chromium ion in the aqueous reaction medium, i.e. the chromium is in solution. U.S. Pat. No. 3,616,323 teaches that the electrical efficiency of the electrochemical conversion of phenol to hydroquinone using lead anodes is enhanced by preanodizing the lead anodes in an aqueous sulfuric acid solution containing various salts of chromium, manganese, iron, vanadium or nickel. We have found that any effect of preanodizing the lead anodes is soon lost as the anode surface corrodes. We also have found that the addition of manganese sulfate, ferrous sulfate, or nickelous sulfate to the electrolyte solution does not improve current efficiency.

The inclusion of chromium ion in the reaction medium can be accomplished by adding thereto a chromium compound that is soluble in the acidic reaction medium. Examples of such compounds include chromic hydroxide and chromic sulfate. Generally, it is preferred to use a chromium compound that will not introduce into the reaction medium ions that otherwise would not be present in measurable quantities. The minimum amount of chromium ion that should be maintained in the electrolyte solution is 50 ppm. Although the maximum chromium ion concentration is not, within reasonable limits, critical, amounts in excess of about 500 ppm. do not appear to result in substantial benefits for hydroquinone concentrations greater than 2%. Preferably, the chromium ion concentration is at least about 300 ppm. The optimum amount of chromium may depend upon the particular conditions employed, such as phenol concentration, current density, etc.

In batch operations the amount of chromium ion in the electrolyte solution does not diminish significantly and thus there usually is no need to supplement the chromium in the solution during such operations. In continuous operation of the improved process, a loss of chromium may occur during product isolation from the electrolyte solution, thereby requiring the addition of chromium after startup. The need for additional chromium can be readily determined by employing periodically conventional analyses of the cell effluent.

The advantages of the inclusion of chromium ion in the electrolyte solution (reaction medium) as described herein are realized when the oxidation of phenol is carried out at a lead anode, such as is described in U.S. Pat. No. 3,509,031, or a lead-thallium alloy anode, such as is described in British Pat. No. 1,260,962. Although the particular cathode material employed is not critical, cathodes fabricated from lead, nickel and stainless steel are the most suitable. The cell design, process materials, and operating conditions useful in practicing our improved process are well known as evidenced by the U.S. patents cited hereinabove which are incorporated herein by reference.

The process of this invention is further illustrated by the following examples.

EXAMPLE 1

A modified 1—1. resin flask is equipped with a Vibro-Mixer stirrer, chilled water cold finger, thermometer, and two electrodes. The cathode is a half-cylinder of nickel screen (Electromesh 120 count, nickel on copper screen), placed upright in the cell. The anode, a strip of lead −2% thallium alloy, is cleaned ½ hour in a bath of 20% aqueous acetic acid, containing 0.7% sodium nitrite, and is wiped clean while under a vigorous stream of demineralized water to give a bright surface. The cathode is cleaned with a mixture of ethanol and concentrated hydrochloric acid. The electrodes are immediately placed in the cell and the anode is preanodized at 100–200 ma. for 30 to 45 min. in 3% sulfuric acid. The cell is drained and immediately charged with a solution of 30 g. of phenol and 30 g. of concentrated sulfuric acid in 940 g. water. Two runs are made with the addition of 7.3 g. phenol every 1.5 hours at 10 amps (40 A/dm² average anode current density). The results, expressed as an average of the two runs, are shown in Table 1. The p-benzoquinone concentration is less than 0.05% for each run.

In Table 1, hydroquinone (HQ) concentration by weight and current efficiency (CE) are shown at different points of time during the runs. The values for phenol indicate varying concentrations by weight during the runs.

EXAMPLE 2

Example 1 repeated with the addition of 27 ppm chromic sulfate to the electrolyte. The results are shown in Table 1.

EXAMPLE 3

Example 1 is repeated with the addition of 266 ppm. chromic sulfate to the electrolyte. The results, an average of two runs are shown in Table 1.

EXAMPLE 4

Example 1 is repeated with the addition of 540 ppm. chromic sulfate to the electrolyte. The results are shown in Table 1. In each of the runs of Examples 2, 3 and 4 the p-benzoquinone concentration is less than 0.05%.

EXAMPLE 5

Example 1 is repeated using a lead anode. Two runs are made with the addition of 6.3 g. phenol every 1.5 hr. at 10 amps (40 A/dm² average anode current density). The results, an average of the two runs, are set forth in Table 1.

EXAMPLE 6

Example 5 is repeated with the addition of 32 ppm. chromic sulfate to the electrolyte. The results are shown in Table 1.

EXAMPLE 7

Example 5 is repeated with the addition of 156 ppm. chromic sulfate. The results are shown in Table 1.

EXAMPLE 8

Example 5 is repeated with the exception that the anode is preanodized in 3% sulfuric acid containing 50 ppm Cr (added as chromic sulfate) and washed with water. No chromium is added to the run. The results appear in Table 1.

EXAMPLE 9

Example 8 is repeated using 280 ppm Cr (added as chromic sulfate) during the preanodization. No chromium is added to the run. The results is as follows:

TABLE 1

| Example | Temp., ° C. | Phenol, % | Time, hr. | HQ, % | CE, % |
|---|---|---|---|---|---|
| 1 | 34–39 | 2.5–3.6 | 3.0 | 0.95 | 29.8 |
| | | | 7.5 | 2.16 | 26.2 |
| | | | 10.5 | 3.03 | 25.0 |
| 2 | 35–38 | 2.5–4.3 | 3.0 | 0.95 | 29.6 |
| | | | 7.5 | 2.30 | 27.2 |
| | | | 10.5 | 3.10 | 24.6 |
| 3 | 35–39 | 2.5–3.7 | 3.0 | 1.04 | 32.3 |
| | | | 7.5 | 2.50 | 30.0 |
| | | | 10.5 | 3.38 | 28.2 |
| 4 | 35–39 | 2.5–3.1 | 3.0 | 1.12 | 35.3 |
| | | | 7.5 | 2.48 | 30.1 |
| | | | 10.5 | 3.42 | 29.0 |
| 5 | 33–41 | 2.5–3.1 | 4.5 | 1.38 | 28.2 |
| | | | 7.5 | 2.17 | 26.4 |
| | | | 10.5 | 2.99 | 25.4 |
| 6 | 35–38 | 2.5–3.3 | 4.5 | 1.44 | 29.6 |
| | | | 7.5 | 2.14 | 26.1 |
| | | | 10.5 | 2.90 | 24.7 |
| 7 | 37–40 | 2.5–3.1 | 4.5 | 1.57 | 32.6 |
| | | | 7.5 | 2.46 | 29.9 |
| | | | 10.5 | 3.20 | 27.0 |
| 8 | 36–40 | 2.5–3.5 | 4.3 | 1.40 | 29.1 |
| | | | 7.5 | 2.14 | 26.1 |
| | | | 10.5 | 2.74 | 23.4 |
| 9 | 33–38 | 2.5–3.2 | 4.5 | 1.37 | 28.5 |
| | | | 7.5 | 2.17 | 26.5 |
| | | | 10.5 | 3.02 | 25.6 |

The above examples establish that the use of chromium ion in concentrations less than 50 ppm. results in improved current efficiencies while the use of higher concentrations gives significantly improved current efficiencies. Although significant advantages may be realized under certain operating conditions when using 50 ppm., the amount of chromium ion used preferably is at least 300 ppm. The examples also show best current efficiencies are achieved at the lowest hydroquinone concentrations determined in the example runs and that current efficiency decreases as the hydroquinone concentration in the electrolysis mixture increases. Accordingly, it is preferred that the hydroquinone concentration does not exceed about 2.5 weight percent. Such a concentration can be maintained using conventional techniques. For example, in continuous operation the cell effluent can be extracted continuously to remove hydroquinone therefrom.

The invention has been described in detail with particular reference to preferred embodiments thereof, but it will be understood that variations and modifications can be effected within the spirit and scope of the invention.

We claim:

1. In the process for the electrochemical oxidation of phenol to hydroquinone in an aqueous medium at a lead or lead-thallium alloy anode in an undivided cell, the improvement which comprises the inclusion in the aqueous medium of at least 50 ppm. of chromium ion.

2. In the process of claim 1 wherein the improvement comprises the inclusion in the aqueous medium of at least 300 ppm. of chromium ion.

3. In the process of claim 1 for the electrochemical oxidation of phenol to hydroquinone in an aqueous medium at a lead or lead-thallium alloy anode in an undivided cell, the improvement which comprises the inclusion in the aqueous medium of at least 300 ppm. of chromium ion while maintaining the concentration of hydroquinone at about 2.5 weight percent or less.

* * * * *